US005494595A

United States Patent [19]

Nieh

[11] Patent Number: 5,494,595

[45] Date of Patent: Feb. 27, 1996

[54] OIL SOLUBLE POLYETHERS

[75] Inventor: Edward C. Y. Nieh, Austin, Tex.

[73] Assignee: Huntsman Corporation, Salt Lake City, Utah

[21] Appl. No.: 366,857

[22] Filed: Dec. 30, 1994

[51] Int. Cl.[6] ..... C10M 105/18; C10M 107/22; C10M 129/16

[52] U.S. Cl. ..... 252/52 A; 568/608; 568/613; 568/618; 568/622; 568/625

[58] Field of Search ..... 252/52 A; 568/608, 568/613, 618, 622, 625

[56] References Cited

U.S. PATENT DOCUMENTS

| | | | |
|---|---|---|---|
| 4,481,123 | 11/1984 | Hentschel et al. | 252/52 R |
| 4,711,734 | 12/1987 | Fujita et al. | 252/52 A |
| 4,973,414 | 11/1990 | Nerger et al. | 252/52 A |
| 5,143,640 | 9/1992 | Moxey | 252/52 R |
| 5,425,894 | 6/1995 | Welch et al. | 568/625 |

FOREIGN PATENT DOCUMENTS

| | | |
|---|---|---|
| 64236 | 11/1982 | European Pat. Off. . |
| 50-133205 | 10/1975 | Japan . |

OTHER PUBLICATIONS

S. Kussi, "Polyethers as Base Fluids to Formulate High Performance Lubricants©", *Lubrication Engineering*, Nov., 1991, pp. 926–933.

Cracknell, R. B., "Oil Soluble Polyethers in Automotive Crankcase Lubricants©", 47th Annual Meeting in Philadelphia, PA., May 4–7, 1992, pp. 1–23.

Ullmann's Encyclopedia of Indusrial Chemistry, Verlag Chemie, Weinhem, 4th Edition, vol. 20, p. 504 (date unknown).

*Primary Examiner*—Jerry D. Johnson

*Attorney, Agent, or Firm*—Russell R. Stolle; Ron D. Brown

[57] ABSTRACT

This invention discloses an oil soluble polyether composition, comprising:

$$RO(\overset{CH_3}{\overset{|}{CH_2CHO}})_iA_o(\overset{CH_3}{\overset{|}{CH_2CHO}})_jA_p(\overset{CH_3}{\overset{|}{CH_2CHO}})_kA_q(\overset{CH_3}{\overset{|}{CH_2CHO}})_lH$$

wherein R is either a $C_{14-20}$ alkyl or $C_{9-12}$ alkylphenyl;

A is $$-CH_2\underset{\underset{CH_2O(CH_2)_xCH_3}{|}}{CHO}-$$

where x is from 7 to 13;

i, j, k, and l are each independently from 0 to 35 and the sum (i+ j+ k+ l) is from 8 to 35;

o, p, and q are each independently 0 to 1 and the sum (o+ p+ q) is from 0 to 3; and, the average mole ratio of the glycidyl ether monomeric unit A to the initiator unit RO is from 0.4:1 to 1.5:1.

This invention also discloses an anionic polymerization process for producing an oil soluble polyether composition, comprising reacting a mixture of propylene oxide and a $C_{8-14}$ alkyl glycidyl ether with an initiator obtained from the group consisting of a $C_{14-20}$ alkanol and a $C_{9-12}$ alkylphenol under the influence of an alkaline metal alkoxide catalyst.

8 Claims, No Drawings

OIL SOLUBLE POLYETHERS

BACKGROUND OF THE INVENTION

1. Field of the Invention

The present invention relates to oil soluble polyethers.

2. Background Information

Since aliphatic polyethers are in general hydrophilic substances, common polyethers have poor miscibility with hydrophobic substances. This is especially true for the vast majority of polyoxyalkylene glycols which are used as lubricants. Thus, in Ullmanns Encyclopädie der technischen Chemie (Ullmann's Encyclopedia of Industrial Chemistry), Verlag Chemie, Weinheim, 4th edition, volume 20, page 504, Table 29, for example, polyoxyalkylene glycols are classified as being poorly miscible with mineral oils.

Therefore, attempts have been made to develop special polyethers having good miscibility with mineral oils. These polyethers are known as oil soluble polyethers. Oil soluble polyethers are generally modified polymers of propylene oxide. They are derived from the copolymerization of propylene oxide and an alpha-olefin epoxide onto a hydrocarbon starter containing one or more active protons. Oil soluble polyethers are often used as base stocks and components for fully and partially synthetic lubricants. Polyether based lubricants offer longer service life, higher efficiency in gears, bearings, hydraulics, automotive crankcases, etc. and better thermal stability compared to mineral oils. Hence, as indicated in Crachnell, R. B., "Oil Soluble Polyethers in Automotive Crankcase Lubricants", Society of Tribologists and Lubricant Engineers, STLE Preprint No. 92-AM-6E-5, oil soluble polyethers have excellent potential as synthetic lubricant base fluids.

It is known that the various possible polyether types which can be used as base fluids for industrial lubricants present a challenge for the study of their properties. S. Kussi, "Polyethers as Base Fluids to Formulate High Performance Lubricants", Lubrication Engineering, Volume 47, 11, 926–933, November, 1991. Kussi's article discusses the chemical, physical, and tribological properties of different polyether types through specific applications, like metal-working processes and lubrication of gears and bearings. Kussi's article also considers a number of important polyether structures by using different lubricity test equipment.

Although, as Kussi's article indicates, this is a challenging area of research, development of certain polyethers having improved miscibility with mineral oils has occurred. It is known from Japanese Kokai 50/133205 that polyethers having the general formulae $R^1O(AO)_nR^2$ and $R^1O((AO)_mCH_2)(AO)_mR^1$ where $R^1$ and $R^2$ are $C_1$ to $C_{24}$ hydrocarbyl and/or hydrogen, m is 1 to 100, n is 1 to 50 and A is $C_pH_{2p}$ where p is 2 to 26, can be used as lubricating oils when mixed with mineral oils. Thus, 50/133205 describes polyethers based on ethylene oxide, propylene oxide and/or butylene oxide and a longer-chain 1,2-epoxyalkane with up to 26 carbon atoms having, if desired, one or two hydroxyl terminal groups. The publication discloses that, to guarantee miscibility with mineral oils, the 1,2-epoxyalkane having up to 26 carbon atoms must be present in the polyethers in an amount of approximately 40% by weight or more. In these formulations it is preferred that the mineral oil is the major component. However, such materials tend to have excessive coefficients of shearing friction which makes them unsuitable for many applications. Moreover, in contrast to ethylene oxide and propylene oxide, long-chain 1,2-epoxyalkanes are not petrochemical primary products, and must be prepared synthetically. The incorporation of large amounts of long-chain 1,2-epoxy-alkanes into polyether which are miscible with mineral oils is therefore technically and economically demanding and unsatisfactory.

Mineral oil-soluble polyethers are also described in European Published Specification ("EP-OS") 0,064,236. These are tetrahydrofuran-containing copolyethers which are only accessible by a cationic polymerization process. Such cationic polymerization processes require special reactor materials and equipment due to the aggressive nature of the catalysts. Therefore, they can not be carried out in plants which are customarily used for anionic epoxide polymerizations. In addition, to achieve good miscibilities with mineral oils, long-chain 1,2-epoxyalkanes in amounts of over 40% by weight are in practice necessary even for the polyethers described in EP-OS 0,064,236 (see Comparative Examples V–VIII and Table 2 in U.S. Pat. No. 4,973,414).

If an attempt is made to prepare low-viscous lubricants based exclusively on the polyethers known from EP-OS 0,064,236, for example, those of the important viscosity class ISO-VG 68, it is found that high evaporation losses occur (See Comparative Example 9 in U.S. Pat. No. 4,973,414) which can be repressed for only a short time by means of customary amounts of antioxidants. The addition of large amounts of antioxidants is not a solution to the problem, since it results in a deterioration of the lubricant properties.

Previously, there have been no mineral or synthetic oil miscible polyethers which are technically and economically completely satisfactory in the field of lubricants. Moreover, the prior art described above generally teaches the desirability of using mineral oil/polyether lubricants only when the mineral oil constitutes the major component of the lubricant.

The instant invention provides novel oil soluble polyether compositions that can be used as base stocks and components for fully and partially synthetic lubricants. That is, the novel oil soluble polyethers can be used either in the absence of mineral oil or in mineral oil/polyether mixtures where the mineral oil comprises only the minor component. These novel oil soluble polyether compositions can be used to improve the miscibility of certain oil insoluble polyethers in mineral oil or synthetic oil (e.g., such as hydrogenated polyalpha olefin products). This invention allows for control over viscosity and viscosity index over a broad range. Moreover, this invention allows for the selective control over miscibility in synthetic and mineral oil based lubricants. These oil soluble polyethers are useful as automotive or industrial lubricants and are compatible with conventional mineral oils. Thus, the instant oil soluble polyethers are technically and economically superior to prior art products in the field of lubricants.

Moreover, the oil soluble polyethers of the instant invention have the economic advantage that they are primarily petrochemical primary products and require minimal synthesis as compared to prior art oil soluble polyethers.

SUMMARY OF THE INVENTION

This invention is an oil soluble polyether composition, comprising:

$$RO(\overset{\overset{CH_3}{|}}{CH_2CHO})_iA_o(\overset{\overset{CH_3}{|}}{CH_2CHO})_jA_p(\overset{\overset{CH_3}{|}}{CH_2CHO})_kA_q(\overset{\overset{CH_3}{|}}{CH_2CHO})_lH$$

wherein R is either a $C_{14-20}$ alkyl or $C_{9-12}$ alkylphenyl;

A is an alkyl glycidyl ether of the following formula:

$$-\underset{\underset{CH_2O(CH_2)_xCH_3}{|}}{CH_2CHO}-$$

wherein x is from 7 to 13;

i, j, k, and l are each independently from 0 to 35 and the sum (i+ j+ k+ l) is from 8 to 35;

o, p, and q are each independently 0 to 1 and the sum (o+ p+ q) is from 0 to 3; and, the mole ratio of the glycidyl ether monomeric unit A to the initiator unit RO is from 0.4:1 to 1.5:1.

This invention is also an anionic polymerization process for producing an oil soluble polyether composition, comprising reacting a mixture of propylene oxide and a $C_{8-14}$ alkyl glycidyl ether with an initiator obtained from the group consisting of a $C_{14-20}$ alkanol and a $C_{9-12}$ alkylphenol under the influence of an alkaline metal alkoxide catalyst.

The instant invention provides novel oil soluble polyether compositions that can be used as base stocks and components for fully and partially synthetic lubricants. That is, the novel oil soluble polyethers can be used either in the absence of mineral oil or in mineral oil/polyether mixtures where the mineral oil comprises only the minor component. These novel oil soluble polyether compositions can be used to improve the miscibility of certain oil insoluble polyethers in mineral oil or synthetic oil (e.g., such as hydrogenated polyalpha olefin products). This invention allows for control over viscosity and viscosity index over a broad range. Moreover, this invention allows for the selective control over miscibility in synthetic and mineral oil based lubricants. These oil soluble polyethers are useful as automotive or industrial lubricants and are compatible with conventional mineral oils. Thus, the instant oil soluble polyethers are technically and economically superior to prior art products in the field of lubricants.

Moreover, the oil soluble polyethers of the instant invention have the economic advantage that they are primarily petrochemical primary products and require minimal synthesis as compared to prior art oil soluble polyethers.

DESCRIPTION OF THE PREFERRED EMBODIMENT

The oil soluble polyether compositions of the instant invention are derived from the copolymerization of propylene oxide and an alkyl glycidyl ether onto a hydrocarbon initiator containing one or more active protons.

The oil soluble polyether compositions of the instant invention have the general formula:

$$RO(\overset{\overset{CH_3}{|}}{CH_2CHO})_iA_o(\overset{\overset{CH_3}{|}}{CH_2CHO})_jA_p(\overset{\overset{CH_3}{|}}{CH_2CHO})_kA_q(\overset{\overset{CH_3}{|}}{CH_2CHO})_lH$$

wherein R is the initiator and is either a $C_{14-20}$ alkyl or a $C_{9-12}$ alkylphenyl;

i, j, k, and l are each independently from 0 to 35 and the sum (i+ j+ k+ l) is from 8 to 35;

o, p, and q are each independently 0 to 1 and the sum (o+ p+ q) is from 0 to 3;

A is the alkyl glycidyl ether; and, the average mole ratio of A to RO is from 0.4:1 to 1.5:1.

In the above general formula, A has the formula:

$$-\underset{\underset{CH_2O(CH_2)_xCH_3}{|}}{CH_2CHO}-$$

where x is from 7 to 13.

The instant hydrocarbon initiator, also referred to as "R", is suitably an alkyl or alkylphenyl group having from 9 to 20 carbon atoms. Where R is an alkyl group, R is preferably a $C_{14}$ to $C_{20}$ group, such as might be obtained from a corresponding alcohol. More preferably, R is obtained from a n-$C_{16-18}$ alkanol, equivalent weight 256, available from Albemarle. Where R is an alkylphenyl group, R is preferably a $C_9$ to $C_{12}$ alkyl group having a phenyl group substituted with one or more $C_6$ alkyl groups being preferred. The most preferred R is obtained from a linear or branched dodecylphenol. Reference is also made herein to the initiator unit, also referred to as "RO".

The instant alkyl glycidyl ethers, also referred to as "A", may be prepared from epichlorohydrine and the corresponding alcohol under alkaline conditions. The instant alkyl glycidyl ethers may also be obtained commercially from Shell Chemical Co. as HELOXY® WC-8 (n-$C_{12-14}$ linear alkyl glycidyl ether, equivalent weight 290) and Heloxy WC-7 (n-$C_{8-10}$ linear alkyl glycidyl ether, equivalent weight 227).

The instant oil soluble polyethers suitably have a molecular weight in the range of from about 600 to about 3000, and more preferably from about 700 to about 2500. They are also characterized by having a viscosity from about 0 to about 30 cs at 100° C.

The instant oil soluble polyether compositions are prepared by an anionic polymerization process which involves reacting a mixture of propylene oxide and a $C_{8-14}$ alkyl glycidyl ether with an initiator selected from either a $C_{14-20}$ alkanol or a $C_{9-12}$ alkylphenol under the influence of an alkaline metal alkoxide catalyst.

The weight ratio of the initiator to the mixture of propylene oxide and the alkyl glycidyl ether is preferably from about 3:10 to about 3:17, respectively. More preferably, the weight ratio is about 3:17.

The relative weight percents within the mixture are preferably about 15% of the alkyl glycidyl ether and about 85% propylene oxide.

The alkaline metal alkoxide catalysts useful in the present invention include cesium hydroxide, potassium hydroxide and sodium hydroxide. The use of potassium hydroxide as the alkaline metal alkoxide catalyst is preferred.

The principles of performing an anionic epoxide polymerization are known to one skilled in the art (see for example Houben-Weyl, volume 14/2, page 425 et seq. (1963); Kirk-Othmer, volume 18, page 624 and 638 to 641 (1982) and Ullmann, Encyclopädie der technischen Chemie (Encyclopedia of Industrial Chemistry), volume 19, pages 33 to 34 and 36 (1981)). During the preparation of the instant polyethers, care must be taken that volatile components and impurities are meticulously removed, for example by vacuum stripping. Otherwise, additional losses through evaporation which are not due to degradation or decomposition effects can occur when these compounds are used as lubricants. The preferred conditions for performing the instant anionic epoxide polymerization process are from about 80° C. to about 150° C. and from about 5 psig to about 200 psig.

The incorporation of alkyl glycidyl ether units relative to propylene oxide units can be accomplished randomly, but also in blocks, and also by following a distribution gradient ("tapered copolymers"). In some instances, it may be advantageous to incorporate the alkyl glycidyl ether units as a block at the hydroxyl terminus of the polyether monoalcohols.

The instant process affords a greater degree of incorporation of the alkyl glycidyl ether units the higher the molecular weight of the composition. This advantageously provides a greater amount of the alkyl glycidyl ether units for the higher molecular weight compositions where it is more needed and comparatively less alkyl glycidyl ether units in the lower molecular weight compositions where it is less needed.

The alkyl glycidyl ether units are less needed in the lower molecular weight ranges of the instant polyether because of the lipophobic initiator to oxyalkylene ratio is greater. More alkyl glycidyl ether units are needed when the molecular weight of the instant polyether is higher because otherwise these materials would have a less favorable lipophilic to lipophobic balance.

The industrial and automotive lubricating oil of the present invention consists essentially of the polyether defined above optionally together with synthetic or mineral oils, including, hydrogenated polyalpha olefin, napthenic and paraffinic oils, and optional additives such as pour point depressants, detergent additives, anti-wear additives, extreme pressure additives, anti-oxidants, anti-corrosion and anti-foam agents etc.

The industrial and automotive lubricating oils of the present invention are particularly suitable as automotive gear and crankcase lubricants, two stroke engine lubricants, and industrial gear lubricants. The lubricating oils can also be used as transmission fluids in automobiles.

The polyethers according to the invention can, if desired after the addition of customary additives, be used as lubricants or lubricant components. The present invention therefore also relates to lubricants containing the instant polyethers. Mixed with other polyethers, the instant polyethers improve the thermooxidative stability thereof. By adding antioxidants, this stability is reinforced synergistically. Finally, due to the specific solvent properties of the instant polyethers together with mineral oils and/or polyalphaolefins, partly or fully synthetic lubricants having a high performance profile can be formulated.

The term "lubricant viscosity" is to be understood as meaning a material property which excludes materials having a viscosity which is insufficient for lubricants. In general, a minimum viscosity (measured in a lubrication gap under a load) of at least 2 $mm^2/s$ is required.

Particular preference is given to those mixtures which contain 15 to 35 parts by weight of the instant polyethers. Furthermore, it is also advantageous to mix the instant polyethers with lubricants based on esters, phosphates, glycols and polyglycols, for example 5 to 50% by weight of the instant polyethers with 50 to 95% by weight of lubricants based on other materials and, if desired, with conventional amounts of conventional additives.

Lubricants and lubricant mixtures containing the instant polyethers can, in addition, contain conventional additives which improve the basic properties of lubricants, for example antioxidants, metal-passivating agents, rust inhibitors, viscosity index improvers, pour point depressants, dispersing agents, detergents, high-pressure additives and/or anti-wear additives.

The antioxidants can be for example phenol derivatives, in particular alkylated monophenols, alkylated hydroquinones, hydroxylated thiodiphenyl ethers, alkylidene-bisphenols, benzylphenol compounds, acylaminophenols, esters or amides of β-(3,5-di-tert.-butyl- 4-hydroxyphenyl)-propionic acid or esters of β-(5-tert.-butyl-4-hydroxy-3-methylphenyl)-propionic acid. All these phenol derivatives can contain alkyl groups. They can be for example methyl, ethyl, n-butyl, i-butyl, t-butyl, octyl, nonyl, dodecyl, octadecyl, cyclopentyl, cyclohexyl, and methylcyclohexyl groups. If desired, even more substituents can be present, for example methoxy groups. Esters can be for example those with $C_1$ to $C_{20}$ mono or polyalcohols, in particular esters of methanol, neopentylglycol and pentaerythritol. Amides can be for example those based on trimethylenediamine, hexamethylenediamine or hydrazine.

Typical representatives of said classes of phenol derivatives are for example 2,6-di-tert.-butyl- 4-methylphenol, 2,6-di-tert.-butyl-4-methoxyphenol, 2,2'-thio-bis-(6-tert.-butyl-4-methylphenol), 2,2'-methylene-bis(6-tert.-butyl-4-methylphenol), 2,2'-ethylidene-bis-(6-tert.-butyl- 4-isobutylphenol), 1,3,5-tri-(3,5-di-tert.-butyl-4-hydroxybenzyl)-2,4,6-dimethylbenzene, bis-(4-tert.-butyl-3-hydroxy-2,6-dimethylbenzyl)-dithiol terephthalate, dioctadecyl 3,5-di-tert.-butyl- 4-hydroxybenzyl phosphonate and 4-hydroxylauric anilide.

Antioxidants can also be amines, for example N,N'-diiosopropyl-p-phenylenediamine, N-phenyl-1-naphthylamine, 4-butyrylamino-phenol, 2,4'-diaminodiphenylmethane or substituted diphenylamines.

Metal-passivating agents can be for example benzotriazole, tetrahydrobenzotriazole, 2-mercaptobenzothiazole, salicylidene-propylenediamine and salts of salicylaminoguanidines. Suitable rust inhibitors are for example organic acids, esters thereof, metal salts and anhydrides thereof, nitrogen-, phosphorus- and sulphur-containing compounds, such as N-oleoylsarcosin, lead naphthenate, dodecenylsuccinic anhydride, 4-nonylphenoxyacetic acid, oil-soluble alkylammonium carboxylates, substituted imidazolines and oxazolines, amino salts of the partial esters of phosphoric acid and barium dinonylnaphthalenesulphonates.

Viscosity index improvers are for example polymethacrylates, vinylpyrrolidonemethacrylate copolymers, polybutenes, olefin copolymers and styrene-acrylate copolymers, and also esters of aromatic dicarboxylic acids with polytetrahydrofurandiols (see DE-OS (German Published Specification) 3,221,137).

Suitable pour point depressants are for example polymethacrylates and alkylated naphthalene derivatives.

Examples of dispersing agents and/or surfactants are polybutenylsuccinimides, polybutenylphosphonic acid derivatives and basic magnesium, calcium and barium sulphonates and basic magnesium, calcium and barium phenolates.

High-pressure and/or wear-reducing additives can be for example compounds containing sulphur, phosphorus or halogens, such as sulphurized vegetable oils, zinc dialkyldithiophosphonates, tritolyl phosphate, chlorinated paraffins and alkyl and aryl disulphides.

Altogether, the additives are in general present in the lubricants which contain the polyethers according to the invention in an amount of no more than 10% by weight and individual additive components of no more than 3% by weight.

The following Examples are merely illustrative and should not be construed as limitations on the scope of the claims.

EXAMPLE 1

Into a five-gallon kettle were charged dodecylphenol, 3.0 lb., and a 45% aqueous solution of potassium hydroxide, 160 grams. The reactor was then purged with purified nitrogen under vacuum at 100° C. for a period of 45 minutes in order to remove water. A monomer mixture, consisting of Heloxy WC-8 (n-$C_{12-14}$ linear alkyl glycidyl ether, equivalent weight 290, available from Shell Chemical Co.) 15% by weight and propylene oxide 85% by weight, 17.0 lb., was added to the kettle at 110° C. to 115° C. and 60 psig over a period of four hours. The reaction mixture was digested to equilibrium pressure. The product was cooled to 90° C. and then was stirred with 480 grams of MAGNISOL® (a synthetic silica magnesium clay available from Reagent Research & Chemical Co. ) in the form of a water slurry for a period of one hour at 90° to 95° C. The reaction mixture was evacuated at 110° C. for 30 minutes and filtered. The properties of the finished product are listed in Table 1.

EXAMPLE 2

The procedure of Example 1 was followed to produce an oil-soluble polyether composition from EPAL 1618 (n-$C_{16-18}$ alkanol, equivalent weight 256, available from Albemarle), 3.0 lb., and a monomer mixture (consisting of HELOXY® WC-8 15% by weight and propylene oxide 85% by weight), 17.0 lb. The properties of the finished product are listed in Table 1.

EXAMPLE 3

The procedure of Example 1 was followed to produce an oil-soluble polyether composition from dodecylphenol, 3.0 lb., and a monomer mixture, consisting of HELOXY® WC-7 (n-$C_{8-10}$ to alkyl glycidyl ether, equivalent weight 227), 15% by weight and propylene oxide 85% by weight, 17.0 lb. The properties of the finished product are listed in Table 1.

EXAMPLE 4

The procedure of Example 1 was followed to produce an oil-soluble polyether composition from EPAL 1618, 3.0 lb., and a monomer mixture, consisting of HELOXY® WC-7 15% by weight and propylene oxide 85% by weight, 17.0 lb. The properties of the finished product are listed in Table 1.

EXAMPLE 5

The procedure of Example 1 was followed to produce an oil-soluble polyether composition from dodecylphenol, 3.0 lb., and a monomer mixture, consisting of HELOXY® WC-7 15% by weight and propylene oxide 85% by weight, 10.0 lb. The properties of the finished product are listed in Table 1.

EXAMPLE 6

The procedure of Example 1 was followed to produce an oil-soluble polyether composition from EPAL 1618, 3.0 lb., and a monomer mixture, consisting of HELOXY® WC-7 15% by weight and propylene oxide 85% by weight, 10.0 lb. The properties of the finished product are listed in Table 1.

EXAMPLE 7

The procedure of Example 1 was followed to produce a polyether from EPAL 1618, 3.0 lb., and propylene oxide, 17.0 lb. The properties of the finished product are listed in Table 1.

EXAMPLE 8

The procedure of Example 1 was followed to produce a polyether from dodecylphenol, 3.0 lb., and a propylene oxide, 17.0 lb. The properties of the finished product are listed in Table 1.

EXAMPLE 9

TCC-459, a Huntsman Corporation product, was produced by procedure similar to Example 1 from nonylphenol, 222 parts by weight, and propylene oxide, 778 parts by weight. The properties of the finished product are listed in Table 1.

EXAMPLE 10

This example illustrates that the instant compositions improve the miscibility of the less miscible polyethers in synthetic or mineral oil based lubricants. Homogeneous blends of the oil soluble polyethers from Examples 1 to 6 were made with the oil soluble polyethers from Examples 7 to 9 in a 30%/70% weight ratio. Mixtures of each of the resulting homogeneous blends were made with commercially available base oils. The mixtures contained 25% by weight of the homogeneous blends and 75% by weight of the base oils selected from Mobil SHF-21, Mobil SHF-61 (Mobil SHF series of lubricant oil are based on hydrogenated oligomers of alphaolefin), and Mobil SPN, 160 SUS viscosity ("SPN"), mineral oil. The cloud points of these mixtures, an indicator of the miscibility of the blend, were measured. Results are summarized in Table 2.

It can be seen from Table 2 that 25 parts of the oil soluble polyether from Example 1 was mixed with 75 parts of SHF-21, and separately mixed with 75 parts of SHF-61, and separately mixed with 75 parts of SPN. The cloud point was determined for each resulting mixture. Moreover, 17.5 parts of the oil soluble polyether from Example 1 was mixed with 7.5 parts of the oil soluble polyether from Example 7 and the resulting mixture was then mixed with 75 parts of SHF-21, and separately mixed with 75 parts of SHF-61, and separately mixed with 75 parts of SPN. The cloud point was determined for each resulting mixture. The oil soluble polyether from Example 1 was then separately mixed with the polyethers from Examples 8 and 9.

This procedure was repeated with the polyether from Examples 2 through 6.

TABLE 1

| | OIL SOLUBLE POLYOXYALKYLENE GLYCOL | | | | | | | | |
|---|---|---|---|---|---|---|---|---|---|
| Example | #1 | #2 | #3 | #4 | #5 | #6 | #7 | #8 | #9 |
| Viscosity, cs | | | | | | | | | |
| 210° F. | 17.5 | 14.5 | 17.7 | 15.0 | 11.0 | 10.0 | 19.0 | 15.6 | 14.6 |
| 150° F. | 45.0 | 32.0 | 45.0 | 34.0 | 25.0 | 21.0 | 49.0 | 34.0 | 37.0 |
| 100° F. | 149.0 | 85.0 | 150.0 | 88.0 | 99.0 | 56.0 | 155.0 | 90.0 | 127.0 |
| Acetylatables meq/g | 0.88 | 0.83 | 0.88 | 0.80 | 1.33 | 1.08 | 0.91 | 0.82 | 1.00 |
| Molecular Weight[a] | 1261 | 1402 | 1265 | 1383 | 777 | 1210 | 1278 | 1500 | 1012 |
| Cloud Point[b], | | | | | | | | | |
| SHF-21 | −16 | −22 | −25 | −25 | −21 | −20 | 12 | −15 | −10 |
| SHF-61 | −25 | −22 | −8 | −5 | −10 | −20 | −10 | 37 | 32 |
| SPN | −2 | −10 | −0 | −20 | −16 | −12 | 27 | −2 | −2 |

[a]Weight averages measured using Gel Permeation Chromatograph using polypropyleneglycol standards.
[b]The lowest temperature in °C. at which a solution of 25% Oil Soluble PPG in the based oil stays clear.

TABLE 2

| MISCIBILITY OF OIL SOLUBLE PPG IN BASE OIL | | | | | | | |
|---|---|---|---|---|---|---|---|
| Modified Polypropylene Glycol Products 25 parts | | | | Cloud Point (°C.) | | | |
| | | Example, parts | | | Base Oil, 75 parts | | |
| Example, parts | | #7 | #8 | #9 | SHF-21 | SHF-61 | SPN |
| #1 | 25.0 | — | — | — | −16 | −25 | −2 |
| | 17.5 | 7.5 | — | — | 2 | 25 | 10 |
| | 17.5 | — | 7.5 | — | −10 | 28 | 5 |
| | 17.5 | — | — | 7.5 | −8 | 34 | −3 |
| #2 | 25.0 | — | — | — | −22 | −22 | −10 |
| | 17.5 | 7.5 | — | — | −14 | 35 | 6 |
| | 17.5 | — | 7.5 | — | −23 | 27 | 1 |
| | 17.5 | — | — | 7.5 | −25 | 23 | 2 |
| #3 | 25.0 | — | — | — | −25 | −8 | 0 |
| | 17.5 | 7.5 | — | — | 1 | 28 | 10 |
| | 17.5 | — | 7.5 | — | −10 | 35 | 2 |
| | 17.5 | — | — | 7.5 | −7 | 35 | 3 |
| #4 | 25.0 | — | — | — | −25 | −5 | −20 |
| | 17.5 | 7.5 | — | — | −16 | 37 | 8 |
| | 17.5 | — | 7.5 | — | −25 | 17 | 7 |
| | 17.5 | — | — | 7.5 | −25 | 23 | 3 |
| #5 | 25.0 | — | — | — | −21 | −10 | 16 |
| | 17.5 | 7.5 | — | — | 2 | 34 | 8 |
| | 17.5 | — | 7.5 | — | −18 | 28 | −2 |
| | 17.5 | — | — | 7.5 | −5 | 30 | 0 |
| #6 | 25.0 | — | — | — | −20 | −20 | −12 |
| | 17.5 | 7.5 | — | — | −25 | 26 | 4 |
| | 17.5 | — | 7.5 | — | −24 | 17 | −2 |
| | 17.5 | — | — | 7.5 | −25 | 9 | 2 |

As revealed in Table 1, the oil soluble polyethers of the instant invention provide significantly improved cloud points for mixtures useful as lubricants. For example, the mixture of Example 2 with SPN has a cloud point of −10° C. whereas the mixture of Example 7 with SPN has a cloud point of 27° C., and the mixture of Example 1 with SHF-61 has a cloud point of −25° C. whereas the mixture of Example 8 with SHF-61 has a cloud point of 37° C.

The instant invention provides novel oil soluble polyether compositions that can be used as base stocks and components for fully and partially synthetic lubricants. That is, the novel oil soluble polyethers can be used either in the absence of mineral oil or in mineral oil/polyether mixtures where the mineral oil comprises only the minor component. These novel oil soluble polyether compositions can be used to improve the miscibility of certain oil insoluble polyethers in mineral oil or synthetic oil (e.g., such as hydrogenated polyalpha olefin products). This invention allows for control over viscosity and viscosity index over a broad range. Moreover, this invention allows for the selective control over miscibility in synthetic and mineral oil based lubricants. These oil soluble polyethers are useful as automotive or industrial lubricants and are compatible with conventional mineral oils. Thus, the instant oil soluble polyethers are technically and economically superior to prior art products in the field of lubricants.

Moreover, the oil soluble polyethers of the instant invention have the economic advantage that they are primarily petrochemical primary products and require minimal synthesis as compared to prior art oil soluble polyethers.

We claim:

1. An oil soluble polyether composition, comprising:

$$RO(\overset{\overset{CH_3}{|}}{CH_2CHO})_iA_o(\overset{\overset{CH_3}{|}}{CH_2CHO})_jA_p(\overset{\overset{CH_3}{|}}{CH_2CHO})_kA_q(\overset{\overset{CH_3}{|}}{CH_2CHO})_lH$$

wherein R is either a $C_{14-20}$ alkyl or $C_{9-12}$ alkylphenyl;

A is $$-CH_2\underset{\underset{CH_2O(CH_2)_xCH_3}{|}}{CHO}-$$

where x is from 7 to 13;

i, j, k, and l are each independently from 0 to 35 and the sum (i+ j+ k+ l) is from 8 to 35;

o, p, and q are each independently 0 to 1 and the sum (o+ p+ q) is from 0 to 3; and, the average mole ratio of A to RO is from 0.4:1 to 1.5:1.

2. The composition of claim 1 wherein R is obtained from a dodecylphenol.

3. The composition of claim 2 wherein A is a n-$C_{12-14}$ linear alkyl glycidyl ether.

4. The composition of claim 2 wherein A is a n-$C_{8-10}$ linear alkyl glycidyl ether.

5. The composition of claim 1 wherein R is obtained from an n-$C_{16-18}$ alkanol.

6. The composition of claim 5 wherein A is a n-$C_{12-14}$ linear alkyl glycidyl ether.

7. The composition of claim 5 wherein A is a n-$C_{8-10}$ linear alkyl glycidyl ether.

8. A lubricant composition comprising a polyether according to claim 1 and a mineral or synthetic oil.

* * * * *